US007214728B2

(12) United States Patent
Kimpimaki et al.

(10) Patent No.: US 7,214,728 B2
(45) **Date of Patent: *May 8, 2007**

(54) METHOD OF MAKING A SURFACE SIZE COMPOSITION

(75) Inventors: Tomi Kimpimaki, Turku (FI); Mari Niinikoski, Rusko (FI); Kari Nurmi, Raisio (FI)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/628,481

(22) Filed: Jul. 29, 2003

(65) Prior Publication Data

US 2004/0023004 A1 Feb. 5, 2004

Related U.S. Application Data

(60) Division of application No. 10/038,769, filed on Jan. 8, 2002, now abandoned, which is a continuation of application No. PCT/FI00/00332, filed on Apr. 18, 2000.

(30) Foreign Application Priority Data

Jul. 9, 1999 (FI) ..... 991590

(51) Int. Cl.

| | |
|---|---|
| ***C08L 3/00*** | (2006.01) |
| ***C08K 3/34*** | (2006.01) |
| ***C09K 3/10*** | (2006.01) |
| ***D21H 19/50*** | (2006.01) |
| ***D21H 19/60*** | (2006.01) |
| ***C08J 3/22*** | (2006.01) |

(52) U.S. Cl. ..... 524/17; 524/45; 524/47; 524/55; 524/444; 524/447; 524/448; 524/449; 524/450; 524/451

(58) Field of Classification Search ..... 524/47, 524/17, 45, 55, 444, 447, 448, 449, 450, 524/451

See application file for complete search history.

(56) References Cited

U.S. PATENT DOCUMENTS

| | | | | |
|---|---|---|---|---|
| 6,545,079 | B1 * | 4/2003 | Nurmi et al. | 524/451 |
| 6,753,377 | B1 * | 6/2004 | Niinikoski et al. | 524/734 |
| 2005/0119391 | A1 * | 6/2005 | Mason et al. | 524/445 |

FOREIGN PATENT DOCUMENTS

| | | | |
|---|---|---|---|
| DE | 27 48 243 | | 5/1978 |
| DE | 41 41 860 | | 6/1992 |
| DE | 197 06 574 | | 8/1998 |
| EP | 0 331 656 | | 9/1989 |
| EP | 0918104 | A1 * | 5/1999 |
| GB | 1 392 923 | | 5/1975 |
| GB | 2 019 822 | | 11/1979 |
| JP | 11050388 | | 2/1999 |
| JP | 11-241295 | | 9/1999 |
| WO | WO 98/54410 | | 12/1998 |
| WO | WO 9854410 | A1 * | 12/1998 |

* cited by examiner

*Primary Examiner*—Nathan M. Nutter
(74) *Attorney, Agent, or Firm*—Shiela A. Loggins

(57) ABSTRACT

A size composition for the surface sizing of paper, board or other suchlike. The size composition comprises a size fraction which comprises a water-soluble, principal component made up of, for example, starch, polyvinyl alcohol, carboxymethyl cellulose, glucomannan, protein, or mixtures thereof, and a pigment fraction formed by mixing together a mineral material, which in the main comprises talc particles and/or other phyllosilicate particles, and a binder such as a synthetic polymer, latex and/or other corresponding binder. The size composition is prepared by mixing together the said size fraction and pigment fraction.

30 Claims, No Drawings

METHOD OF MAKING A SURFACE SIZE COMPOSITION

This application is a division of application Ser. No. 10/038,769, filed Jan. 8, 2002, now abandoned, which in turn is a continuation of application No. PCT/FI00/00332, filed Apr. 18, 2000, the entire contents of which are hereby incorporated by reference in this application.

The present invention relates to a size composition, defined in the preambles of the independent claims presented hereinafter, for the surface sizing of paper, board or other suchlike and for the use of the size composition.

Surface sizing is conventionally carried out by means of a sizing device, such as a size press, fitted in the drying section of a paper machine or the like. After the application of the size, the web is directed through the latter part of the drying section, where the size dries. Surface sizing can also be carried out by means of a separate coating unit, for example, when the machine does not have a separate surface sizing unit.

The purpose of sizing is to affect the properties of paper or the like, such as its porosity, strength, hydrophobicity, anti-fluffing property, printability, smoothness and gloss. When necessary, even other webs made from a fibrous material, such as glass fiber mats, can be surface sized.

The purpose of surface sizing is typically to render paper, board or the like suitable for after-treatment. In paper manufacture, the aim in surface sizing is to give the paper a good barrier property, i.e. a tight surface which prevents or substantially limits the penetration of liquids, typically water, into the paper. The penetration of water vapor, gases and/or fats into the paper can also be reduced by surface sizing.

Conventional size compositions, so-called surface sizes, are usually based on starch, carboxymethyl cellulose (CMC), polyvinyl alcohol, glucomannan, or water-soluble proteins, mixtures of the above-mentioned substances being also usable. The starch may be a native starch, degraded and/or chemically modified.

Glucomannan may also be in native form or chemically modified. Examples which can be cited of proteins include gelatin and casein, which may be in native form, or degraded and/or chemically modified. The most important and most commonly used group of surface sizes consists of starch-based sizes.

A surface size is conventionally prepared on site. In connection with the preparation it is possible to add to the size mixture various chemicals individually in order to modify the properties of the size, such as a mineral material, a dispersing agent, a hydrophobification agent, an anti-foaming agent, and/or salts.

The dry matter content of a conventional surface size in a size composition is within the range of 2–16%, at which it is by its flow properties suitable for being applied by a sizing unit. The amount used is typically within the range of 0.5–3 g/m$^2$ per side. However, the amount of surface size to be applied by means of, for example, a coating unit may be even greater.

Surface sizes affect the porosity of paper by reducing pore size and thus by improving the barrier property. However, the desired barrier effect is not always achieved with the normal, relatively small surface size amount. Increasing the size amount is generally not recommendable, since in that case it is necessary at the same time to introduce to the paper web more water, which has to be removed by dewatering.

Furthermore, conventional hydrophilic starch-based surface sizes do not always prevent the penetration of water in the desired manner but, owing to their hydrophilicity, may even increase the absorption of water. One problem in using starch-based sizes is their decreasing effect on wet strength. By using hydrophobification agents, barrier properties are achieved by means of which the penetration of water and other such liquids into the paper can be prevented, but the porosity properties of the paper can hardly be affected.

A good barrier property can be achieved by coating paper with the coating composition described in publication WO 98/54409. In addition to the said barrier property this coating is characterized by its transparency, which is significant in, for example, the coating of printed packaging surfaces. The coating must be carried out in a coating unit. The coating is used in considerably larger quantities than surface size, typically 15–20 g/m$^2$ on one side.

It is previously known to disperse in surface size a mineral material to increase the barrier effect of the size. The adding of a mineral material, in particular a talc-containing mineral material, to size may, however, be very cumbersome on site. It is, for example, necessary to use large amounts of dispersing agents, which often further increase the hydrophilicity of the size and reduce the barrier property.

The object of the present invention is to provide an improved size composition by means of which the above-mentioned problems can be minimized.

The object is thus to provide a size composition by means of which paper can be rendered suitable for after-treatment.

The object is in particular to provide a size composition by means of which the barrier properties, strength and anti-fluffing of paper or the like can be improved.

It is additionally an object to provide a size composition that can be easily prepared on site for use.

In order to achieve the above objects the size composition according to the invention is characterized in what is stated in the characterizing clause of the first claim presented hereinafter.

A typical size composition according to the invention thus comprises

- a size fraction which is typically a surface size known per se and which comprises
  - a water-soluble principal component made up of, for example, starch, polyvinyl alcohol, carboxymethyl cellulose, glucomannan, protein, or mixtures of these, and
  - when necessary, one or more additional components, such as a mineral material, a hydrophobification agent, an anti-foaming agent and/or salts, and
- a pigment fraction, which is formed by mixing together
  - a mineral material which mainly comprises talc particles and/or other phyllosilicate particles, such as muscovite (mica), and
  - a binder, such as a synthetic polymer, latex and/or other corresponding binder.

The final surface size according to the invention is prepared by mixing together the above-mentioned size fraction and ready-mixed pigment fraction. The preparation of the size is in this case carried out typically so that the pigment fraction is mixed into the size fraction, but the mixing can also take place in the opposite order or by adding into the size vessel alternately size fraction and pigment fraction.

The principal component of a typical size fraction according to the invention is starch, the mineral material of the pigment fraction is talc, and the binder a latex polymer. Preferably the degree of purity of the talc is 90–100% and the particle size is 90% below 40 μm.

In a size composition according to the invention, the proportion of talc particles of the mineral material is preferably at minimum 50%, typically >90%. The proportion of talc of the amount of the pigment fraction, calculated as dry matter, is in general >10%, typically >30%, most typically >50%, but, however, <95%, typically <85%, most typically <70% of the amount of the pigment fraction. In a size composition according to the invention the ratio of the pigment fraction to the size fraction, calculated as dry matter, is 10/90–90/10, typically 20/80–80/20, most typically 20/80–50/50.

In a typical size composition according to the invention the binder of the pigment fraction is a synthetic polymer, such as styrene butadiene, acrylate, styrene acrylate or polyvinylacetate latex. The dry matter content of the binder is typically approximately 10–60% and its glass transition temperature is −20° C.–+70° C.

The binder of the pigment fraction may thus be

- a polymer containing styrene or butadiene as its principal component,
- a polymer containing as its principal components monomers containing an acryl or allyl group, which monomers are, for example,
  - n-, iso- or tert-alkyl ester of acrylic or metacrylic acid, wherein the alkyl group comprises 1–20 carbon atoms,
  - a diester of acrylic or metacrylic acid and ethylene or propylene glycol (as a crosslinking component),
  - allylglycidyl ether or diacetone acrylic amide (as a crosslinking component), or
  - 2-acrylamido-2-methylpropane sulfonic acid (as an ionicity-increasing component),
- and which monomers may additionally contain acid or ester groups, or
- they may be amides of acrylic or metacrylic acid, or derivatives-thereof, and/or
- a polymer containing as its principal components vinyl ester monomers, such as vinyl acetate, vinyl propionate, vinyl butyrate, vinyl benzoate, vinyl-2-ethylhexanoate, vinyl stearate, and vinyl ester of versatinic acid.

On the other hand, the pigment fraction binder used in the size composition according to the invention may be a graft copolymer of a starch and a synthetic monomer.

In some size compositions according to the invention it is possible advantageously to use as the binder biodegradable substances, which may be

- starch-based, lactic-acid-based and polyhydroxybutyrate/valerate-based polymers or
- polyesters of various organic di- or tri-acids with alcohols having functionality of two or higher, in which case the said acids may be, for example, adipic, maleic and citric acid and the alcohols, for example, ethylene, propylene and neopentyl glycol and pentarythritol and glycerol.

The pigment fraction used in the invention, having any of the above-mentioned binders and any of the above-mentioned mineral material, typically talc, may additionally contain small amounts of other pigment or mineral materials, as well as wax and dyes. Other pigment or mineral materials may typically be contained in amounts of only a few percent, typically less than 10%. In some special cases, however, other mineral material may be present in an amount of even somewhat over 30% of the total dry matter content of the pigment fraction. These other mineral materials are, for example, kaolin, calcium carbonate, titanium dioxide, gypsum, other silicates, or organic pigment. The dye amount may vary within the range of 0–5% of the total dry matter of the pigment fraction.

When the size composition according to the invention is used it is possible to avoid the separate mixing of poorly dispersible substances, such as mineral materials, with the size on site. For example, talc as a ready-to-use stable dispersion can be mixed into the size fraction considerably more easily than as a separate talc powder.

Before the size fraction and the pigment fraction are mixed together, a hydrophobification agent can also be added to the pigment fraction of the size composition according to the invention, whereby it is also possible to avoid the separate adding of the hydrophobification agent to the size on site. A hydrophobification agent can be added in such an amount that a desired, even precisely determined, absorption of liquids is achieved in the surface-sized paper or the like. The amount of hydrophobification agent is in general 10–20% of the dry matter content of the pigment fraction, but it may be higher or even lower.

By adding according to the invention to a conventional starch-based surface size a phyllosilicate-based pigment fraction, i.e. schistose silicate-based pigment fraction, it is possible by means of the surface size to lower the porosity of paper, i.e. to obtain a better barrier property in the paper without, however, losing the good properties, such as better strength, given to the paper by starch. In a surface size composition according to the invention, the hydrophilicity of starch cannot have as detrimental an effect on the wet strength as in a conventional surface size. These good properties are best retained when 20–50% of the surface size is replaced with a pigment fraction.

The surface size composition according to the invention may be applied with already existing machines intended for the surface sizing of paper or board. The amount used is preferably 0.5–3 $m^2$ of surface size, calculated as dry, per side. Also higher quantities applied are possible in the implementation of the invention.

Papers surface sized with the size according to the invention have a low porosity and a low penetration of liquid. The size composition is well suited for the sizing of special papers such as silicone-treatable base papers or envelope papers. Various papers requiring controlled surface absorption, such as inkjet papers, are also suitable targets for use.

A surface size according to the invention can be used for closing the surface of paper or board, for example, before coating, in which case the water absorption by the coating paste is reduced and the coated surface will be smoother and the structure of the coated paste more homogeneous. A size according to the invention can also be used for improving the performance and final properties of the barrier dispersion described in the publication WO 98/54409 mentioned above.

The invention is illustrated with the help of the accompanying embodiment examples; in Examples 1 and 2 there are first introduced two different ways of preparing the pigment fraction, either by dispersing the talc first in water and then in polymer latex or by dispersing the talc directly in polymer latex.

EXAMPLE 1

Talc, either as a powder or granulated, was slurried in water according to the following recipe:

- 1585.6 g of water, 4.1 g of sodium polyacrylate and 16.2 g of sodium carboxymethyl cellulose were weighed into a dispersion vessel.
- Talc was added to the mixture gradually, in total 2700.0 g High rotation velocities were used in the dispersing in order to break up talc agglomerates.

Halfway through the adding of the talc, 4.1 g of sodium polyacrylate and 2.4 g of sodium hydroxide were further added.

The dispersion vessel was equipped with a cooling mantle, and cooling of the slurry was started when 20 min had elapsed from the ending of the talc adding stage.

Dispersion was thereafter continued for another 20 min.

The product obtained was a talc slurry having a solids content of 63.0% and a viscosity of 200 mPas, measured with a Brookfield LVT viscometer with a measuring head No. 3, at a rotation velocity of 100 r/min. The final pigment fraction was obtained by mixing talc slurry into a polymer latex.

EXAMPLE 2

The talc, either as a powder or granulated, was slurried in a polymer latex according to the following recipe:

181.1 g of water, 1700.0 g of a styrene-butadiene-based polymer latex (solids content 50%, glass transition temperature +20° C.), 3.4 g of sodium hydroxide and 1.7 g of an organomodified siloxane were weighed into a dispersion vessel.

Talc was added to the mixture gradually, in total 1700.0 g. High rotation velocities were used in the dispersing in order to break up talc agglomerates.

The dispersion vessel was equipped with a cooling mantle, and cooling of the slurry was started when 20 min had elapsed from the ending of the talc adding stage.

Thereafter dispersion was continued for another 20 min.

The product obtained was a pigment fraction having a solids content of 68.0% and a viscosity of 1150 mPas, measured with a Brookfield LVT viscometer with a measuring head 5 No. 4, at a rotation velocity of 100 r/min.

The pigment fractions prepared in the manner described above can be used for preparing a size composition suitable for the surface sizing of paper or board by mixing the pigment fraction with a conventional surface size mixture in a proportion of 10–90%, calculated as dry pigment fraction per dry surface size. By a conventional surface size mixture is meant in this context a surface size prepared from the above-mentioned initial components of surface size, for example, from a chemically modified starch and auxiliary substances, such as crosslinking agents, in which surface size the amount of the size component of the total amount of the mixture is in general at minimum 70%, most typically at minimum 90%.

In addition to the above-mentioned principal components it is possible, for certain applications, to add to the size composition a hydrophobification agent, which may be substances known per se for use for the hydrophobification of paper, such as derivatives of natural resin acids, alkyl ketene dimers (AKD), and various hydrophobic polymers used for surface hydrophobification, such as salts of styrene maleic acid (SMA) and styrene acrylates. The proportion of the hydrophobification agent in a surface size composition according to the invention is typically less than 20% of the total surface size composition.

The following examples describe the effect of pigment fractions according to Examples 1 and 2 on the properties of paper and board, the pigment fractions being applied, mixed with a conventional surface size, to the surface of paper or board by surface sizing. The penetration measurements performed in the examples were performed in the following conditions: air temperature 23° C. and relative humidity 50%.

EXAMPLE 3

A product prepared in the manner described above from talc, binder and auxiliary substances was dosed into a cationic potato-starch-based surface size prepared in the conventional manner. The principal component in the binder was a styrene butadiene latex. The adding was done into the mixer, whereby good mixing of the starch with the material added was ensured. Coatings were carried out with the obtained surface size according to the invention by using the film press technique. The samples were dried in IR and airborne driers. The results are recorded in the following Table 1.

TABLE 1

| Coating amount ($g/m^2$)/side | Mixing ratio pigm. fraction/starch | Bendtsen smoothness ml/min | Bendtsen air penetr., ml/min | Dennison surface strength | $Cobb_{60}$ $g/m^2$ |
|---|---|---|---|---|---|
| 2.4 | 0/100 | 300 | 600 | 14 | 37 |
| 2.2 | 10/90 | 360 | 570 | 14 | 35 |
| 1.9 | 20/80 | 270 | 500 | 14 | 32 |
| 2.1 | 30/70 | 260 | 450 | 14 | 31 |
| 1.9 | 40/60 | 240 | 400 | 14 | 28 |

The above results show that, when the proportion of the pigment fraction increases, the smoothness of the surface increases and its porosity decreases. Respectively, the penetration of liquid decreases ($Cobb_{60}$). Nevertheless, the surface strength remains at the same level and does not decrease with the doses used.

EXAMPLE 4

A product prepared in the manner described above from talc, binder and auxiliary substances was dosed into a cationic surface size based on potato starch in the conventional manner. The principal component in the binder was a PVAc-latex. Surface sizing was carried out with the obtained surface size, a paper surface barrier agent, according to the invention by using rod coating. The obtained results are recorded in the following Table 2.

TABLE 2

| Coating amount $g/m^2$ | Mixing ratio pigment fraction/starch | PPS air penetration, μm/Pas | $Cobb_{60}$ $g/m^2$ |
|---|---|---|---|
| 2.7 | 20/80 | 2.5 | 25 |
| 5.4 | 20/80 | 0.5 | 24 |
| 6 | 20/80 | 0.1 | 24 |
| 3.6 | 35/65 | 2 | 23 |
| 6.1 | 35/65 | 0.15 | 22 |
| 6.4 | 35/65 | 0.1 | 22 |
| 2.9 | 50/50 | 1.2 | 21 |
| 5.7 | 50/50 | 0.3 | 16 |
| 6.4 | 50/50 | 0.15 | 15 |

In the main, the same conclusions can be drawn from the results in this table as from the results in the previous Table 1, and additionally that the coating amount also has a significant impact on the final properties obtained.

Furthermore, the table shows that quite small additions of the pigment fraction do not have a significant effect on the water absorption rate.

EXAMPLE 5

A product prepared from talc, binder and auxiliary substances was added to a PVA/CMC (90%/10%) surface size prepared in the conventional manner. The proportion of talc was 64%, the proportion of binder 34% and the proportion of additives 2%. The first dosing was done into the mixer and the following ones directly into the size cycle of the application unit. The size was applied onto the surface of an 80 g/m$^2$ paper.

The obtained results are in the following Table 3.

TABLE 3

| PVA/CMC/ pigment fraction | Coating amount, g/m$^2$ | Curley porosity | Cobb$_{60}$ | Cobb-Unger$_{10}$ |
|---|---|---|---|---|
| 0/100 | 1.4 | 2700 | 23 | 9.2 |
| 40/60 | 1.1 | 1780 | 25.6 | 7.8 |
| 50/50 | 1.2 | 1530 | 26 | 6.2 |
| 60/40 | 1.3 | 870 | 28 | 7.4 |
| 100/0 | 1.3 | 360 | 31 | 6 |

The results in this table show that even small size amounts can be seen to cause a clear change in the obtained porosity and absorption values. On the other hand, it can be noted that the natural tendency of talc to absorb oil is seen in the Cobb-Unger values, which are the best for surface size alone.

EXAMPLE 6

An 80 g/m$^2$ fine paper was surface sized in a size press so that 1.5 g/m$^2$ of a surface size composition according to the invention was applied to both sides. The components used for the surface size composition were a weakly cationized potato starch (1), a pigment fraction (2), a salt of styrene maleic acid (3), and a styrene acrylate (4), according to the following table.

TABLE 5

| | Percent-age | Cobb$_{60}$ | Bendtsen porosity, ml | HST | Ink Jet, 1-color black HP | Epson | Canon |
|---|---|---|---|---|---|---|---|
| 1 | 100 | 22.1 | 965 | 291 | 1.52 | 1.6 | 1.4 |
| 1 + 2 | 95/5 | 19.3 | 920 | 383 | 1.66 | 1.87 | 1.72 |
| 1 + 2 | 90/10 | 18.5 | 855 | 376 | 1.66 | 1.9 | 1.7 |
| 1 + 2 | 85/15 | 18.1 | 865 | 433 | 1.66 | 1.94 | 1.75 |
| 1 + 3 | 90/10 | 20.4 | 870 | 286 | 1.5 | 1.59 | 1.38 |
| 1 + 3 | 75/25 | 21.3 | 710 | 305 | 1.57 | 1.7 | 1.5 |
| 1 + 2 + 3 | 75/5/20 | 18.6 | 650 | 390 | 1.71 | 1.93 | 1.86 |
| 1 + 4 | 95/5 | 21.2 | 995 | 274 | 1.67 | 1.89 | 1.72 |
| 1 + 4 | 90/10 | 19.1 | 975 | 293 | 1.67 | 1.9 | 1.71 |
| 1 + 4 | 85/15 | 19.7 | 960 | 309 | 1.7 | 1.91 | 1.75 |
| 1 + 2 + 4 | 90/5/5 | 19.2 | 910 | 395 | 1.67 | 1.9 | 1.73 |

On the basis of these test results it can be noted that hydrophobification agents can be added to a surface size composition comprising a water-soluble size fraction and a pigment fraction in order to provide new properties for the paper or board surface which are sized with the composition. For example, porosity values and printability values have been improved with these additions.

Some of the most considerable advantages of the invention are that with the size composition according to the invention a paper or board can be provided with good properties for the further treatment of the paper or board, such as good barrier properties, strengths and anti-fluffing properties. A size composition according to the invention, having good rheological properties, can be used in conventional machines in the manner of a conventional surface size.

In a surface size according to the invention, the pigment fraction is, in a manner deviating from conventional pigment fractions, easily dispersible into the surface size. In addition, as the hydrophilic dispersion agent is omitted from the surface size, better barrier properties than previously can be achieved with surface sizing according to the invention for paper or board.

The purpose is not to limit the invention to the applications represented by the examples presented above; but to apply the invention widely within the protective scope defined in the patent claims presented below.

The invention claimed is:

1. A method of making a size composition for the surface sizing of paper, board and the like, comprising the steps of:

(1) forming a pigment fraction by premixing together (a) a mineral material, which mainly comprises talc particles and/or other phyllosilicate particles, and (b) a binder, wherein the binder is a synthetic polymer and/or a latex; and thereafter (2) mixing a size fraction comprised of a water-soluble principal component, and the pigment fraction to thereby form the size composition, wherein the ratio of the pigment fraction to the size faction, calculated as dry matter, is 10/90 to 90/10.

2. A method according to claim 1, wherein the size fraction comprises a surface size.

3. A method according to claim 1, wherein the water-soluble principal component includes starch, polyvinyl alcohol, carboxymethyl cellulose, glucomannan, protein, or mixtures thereof.

4. A method according to claim 1, wherein the size composition is prepared by mixing the pigment fraction into the size fraction.

5. A method according to claim 1, wherein the size composition is prepared by mixing the size fraction into the pigment fraction.

6. A method according to claim 1, wherein the size fraction comprises at least one additional component selected from the group consisting of a mineral material, a hydrophobification agent, and an anti-foaming agent.

7. A method according to claim 1, wherein the principal component of the size fraction is starch, polyvinyl alcohol and/or carboxymethyl cellulose.

8. A method according to claim 1, wherein the mineral material of the pigment fraction is phyllosilicate having a purity degree of 90 to 100% and a particle size of 90% below 40 μm.

9. A method according to claim 1, wherein the mineral material of the pigment fraction comprises talc particles, and the proportion of talc particles of the mineral material is at least 50%.

10. A method according to claim 9, wherein the proportion of talc particles of the mineral material is >90%.

11. A method according to claim 1, wherein the mineral material of the pigment fraction comprises talc particles, and the proportion of talc, calculated as dry matter, of the amount of the pigment fraction is >10%.

12. A method according to claim 11, wherein the proportion of talc is >30%.

13. A method according to claim 11, wherein the proportion of talc is >50%.

14. A method according to claim 11, 12 or 13, wherein the proportion of talc is <95%.

15. A method according to claim 11, 12 or 13 wherein the proportion of talc is <85%.

16. A method according to claim 11, 12 or 13 wherein the proportion of talc is <70%.

17. A method according to claim 1, wherein the ratio of the pigment fraction to the size fraction, calculated as dry matter, is 20/80 to 80/20.

18. A method according to claim 17, wherein the ratio of the pigment fraction to the size fraction, calculated as dry matter, is 20/80 to 50/50.

19. A method according to claim 1, wherein the binder in the pigment fraction is a synthetic polymer.

20. A method according to claim 19, wherein the synthetic polymer is styrene butadiene, acrylate, styrene acrylate or polyvinylacetate latex.

21. A method according to claim 1, wherein the binder in the pigment fraction is:

(1) a polymer which contains styrene or butadiene as its principal component, (2) a polymer which contains as its principal components monomers which contain an acryl or allyl group, wherein the monomers may additionally contain acid or ester groups, or may be amides of acrylic or methacrylic acid or derivatives thereof, and/or (3) a polymer which contains as its principal components vinyl ester monomers.

22. A method according to claim 21, wherein the said monomers include:

an n-, iso- or tert-alkyi ester of acrylic or methacrylic acid, where the alkyl group comprises 1 to 20 carbon atoms, a diester of acrylic or methacrylic acid and ethylene or propylene glycol as a crosslinking component;

allylglycidyl ether or diacetone acrylamide as a crosslinking component; or 2-acrylamido-2-methylpropane sulfonic acid as an ionicity-increasing component.

23. A method according to claim 21, wherein the polymer which contains a vinyl ester monomers as its principal components is vinyl acetate, vinyl propionate, vinyl butyrate, vinyl benzoate, vinyl-2-ethyl hexanoate, vinyl stearate and vinyl esters of versatinic acid.

24. A method according to claim 1, wherein the binder in the pigment fraction is a biodegradable compound.

25. A method according to claim 24, wherein the biodegradable compound is selected from:

polymers based on starch, lactic acid and polyhydroxybutyrate/valerate, of polyesters of various organic di- or tri-acids with alcohols having functionality of two or higher.

26. A method according to claim 25, wherein the organic di- or tri-acid is adipic, maleic or citric acid, and the alcohol having functionality of two or higher is ethylene, propylene and neopentyl glycol, pentarythritol or glycerol.

27. A method according to claim 1, wherein the ready-made, pre-mixed pigment fraction further comprises a hydrophobification agent in an amount sufficient to achieve a desired liquid absorption in the surface-sized paper, board or the like.

28. A method according to claim 1, wherein the ratio of the pigment fraction to the size fraction, calculated as dry matter, is 10/90 to 80/20.

29. A method according to claim 1, wherein the ratio of the pigment fraction to the size fraction, calculated as dry matter, is 10/90 to 50/50.

30. A method according to claim 1, wherein the amount of water-soluble principal component in the size fraction, calculated as dry matter is at least 70%.

* * * * *